US006045375A

United States Patent [19]

Aoki et al.

[11] Patent Number: 6,045,375

[45] Date of Patent: Apr. 4, 2000

[54] SLIDING INSERT TYPE CONNECTOR WITH ASSISTING SLIDER

[75] Inventors: Hiroshi Aoki; Motohisa Kashiyama, both of Shizuoka-ken, Japan

[73] Assignee: Yazaki Corporation, Tokyo, Japan

[21] Appl. No.: 09/105,091

[22] Filed: Jun. 26, 1998

[30] Foreign Application Priority Data

Jun. 27, 1997 [JP] Japan ..... 9-172427

[51] Int. Cl.[7] ..... H01R 13/62

[52] U.S. Cl. ..... 439/157; 439/347

[58] Field of Search ..... 439/157, 310, 439/347

[56] References Cited

U.S. PATENT DOCUMENTS 5,899,762 5/1999 Ainceri ..... 439/157

FOREIGN PATENT DOCUMENTS 6-52929 2/1994 Japan .

*Primary Examiner*—Khiem Nguyen
*Assistant Examiner*—Javaid Nasri
*Attorney, Agent, or Firm*—Finnegan, Henderson, Farabow, Garrett & Dunner, L.L.P.

[57] ABSTRACT

A slide member is slidable on a wall of one of female and male connector housings for an advancing travel and for a retreating travel and formed with an oblique cam element engageable with a cam follower on the other of the female and male connector housings, and drives in the advancing travel the other connector housing to be attracted for insertion to the one connector housing to couple the female and male connector housings with each other and in the retreating travel the female and male connector housings to be de-coupled from each other, and a sliding surface of the slide member with respect to the one connector housing has a raised part formed thereon, in a longitudinal direction thereof, to be brought into line contact with the one connector housing in the advancing travel of the slide member and in the retreating travel thereof.

15 Claims, 4 Drawing Sheets

SLIDING INSERT TYPE CONNECTOR WITH ASSISTING SLIDER

BACKGROUND OF THE INVENTION

1. Field of the Invention

The present invention relates to a sliding insert type connector with an assisting slider, and particularly, it relates to a sliding insert type connector including a couple of male and female connector housings, and an assisting slider for assisting the male connector housing to be inserted in the female connector housing in a sliding manner.

2. Description of Relevant Art

A typical multi-pole sliding connector has a slider formed with an oblique cam groove, and a male connector housing formed with a cam follower engaging with the cam groove. For a coupling between the male connector housing and a female connector housing, the slider is operated to be slid for advancement to intervene therebetween, making the cam follower move along the cam groove, causing the male connector housing to fit in the female connector housing in a sliding manner. For a de-coupling, the slider is operated to be slid for a retreat to cause reverse actions. Operations to the slider do not need undue forces, as the cam groove engages with the cam follower.

FIG. 1 shows an exemplary conventional connector of a sliding insert type that has been disclosed in the Japanese Patent Application Laid-Open Publication No. 6-52929.

In FIG. 1, designated by reference character 1 is the sliding insert type connector, which comprises a front connector housing 5 of a male type, a rear connector housing 2 of a female type, and a U-shaped slider 3 called "slide member".

The female connector housing 2 is comprised of a rear portion formed with arrays of terminal accommodation chambers 2*a*, and a hood portion 2*b* as a front portion shaped in a rectangular tubular form.

The male connector housing 5 is comprised of a front portion formed with arrays of terminal accommodation chambers 5*a*, and an insert portion 5*b* as a rear portion shaped in a rectangular tubular form to be inserted in the hood portion 2*b* of the female connector housing 2.

The slide member 3 is comprised of a vertical operation part 3*a*, and a pair of upper and lower horizontal actuation parts 3*b* reciprocally slidable along respective insides of vertically opposing walls of the hood portion 2*b* of the female connector housing 2. The actuation parts 3*b* of the slide member 3 each have a pair of left and right angled guide grooves 4 engageable with a pair of left and central projections 6 formed outside a corresponding wall of the insert portion 5*b*.

The hood portion 5*b* of the female connector housing 2 has left upper and left lower corner wall parts thereof formed with upper and lower openings 2*c* for insertion of leading ends of the upper and lower actuation parts 3*b* of the slide member 3, respectively. The vertically opposing walls of the hood portion 2*a* each have a plurality of spaced pads 2*d* integrally formed on a front region of the inside thereof, for guiding a corresponding one of the upper and lower actuation parts 3*b*.

Each actuation part 3*b* of the slide member 3 has a reduced thickness along a front edge thereof so that an inside of the actuation part 3*b* has a stepped front region 3*c*, which is interrupted with central and right recesses 3*d* extending thereacross for introducing the left and central projections 6 of the insert portion 5*b* into the left and right group grooves 4 of the actuation part 3*b*.

FIG. 2 shows how to insert the insert portion 5*b* of the male connector housing 5 into the hood portion 2*b* of the female connector housing 2.

As the slide member 3 is operated to advance, the insert portion 5*b* of the male connector housing 5 is pulled inside the hood portion 2*b* of the female connector housing 2, coupling therewith. Upon a retreat operation, the slide member 3 disconnects the coupled housings 2, 5 from each other. Such actions of the sliding insert type connector are described in Japanese Patent Application Laid-Open Publication No. 4-319271.

In the conventional sliding insert type connector 1, when the slide member 3 advances or retreats, the upper and lower actuation parts 3*b* of the member 3 are held in contact with the insides of the vertically opposing walls of the hood portion 2*b*, over relatively large areas on outsides of the actuation parts 3*b*, with relatively large frictional forces acting between the hood portion 2*b* and the actuation parts 3*b*, needing undue forces for operation of the slide member 3.

SUMMARY OF THE INVENTION

The present invention has been achieved with such points in view.

It therefore is an object of the present invention to provide a sliding insert type connector in which a slider is subjected to a reduced frictional force upon contact with a connector housing and operable for a housing coupling advancement and/or a housing de-coupling retreat with a relatively small force, allowing a facilitated smooth operation.

To achieve the object, a first aspect of the invention provides a connector comprising first and a second set of contacts, a first and a second housing for holding the first and the second set of contacts, respectively, the first housing being formed with a plug portion having a first wall defining therein a first region for electrical connection between the first and the second set of contacts, the second housing being formed with a receptacle portion having a second wall defining therein a second region for reception of the plug portion of the first housing, a slide cam member frictionally slidable between the first and second walls for actuating the plug portion of the first housing to be slid into the second region, and line contact means for bringing the slide cam member in line contact with one of the first and second walls.

According to the first aspect of the invention, a slide cam member is brought into line contact with one of walls of a plug portion of a connector housing and a receptacle portion of a mating connector housing, as the slide cam member is operated to intervene between the walls in a frictionally sliding manner for actuating the plug portion to be slid into the receptacle portion.

Accordingly, the slide cam member is subjected to a reduced frictional force upon contact with either connector housing, and is operable for a housing coupling advancement with a relatively small force, allowing a facilitated smooth operation.

According to a second aspect of the invention, the slide cam member is frictionally slidable between the first and second walls for actuating the plug portion of the first housing to be slid out of the second region.

According to the second aspect of the invention, the slide cam member is operable for a housing de-coupling retreat with a relatively small force, allowing a facilitated smooth operation.

According to a third aspect of the invention, the first wall has a cam follower integrated therewith, the slide cam member comprises a plate member formed with a cam groove engageable with the cam follower, and the line contact means comprises a strip element on the plate member.

According to the third aspect of the invention, a simple and inexpensive strip element can make line contact between a plate member and the one of the walls in concern.

According to a fourth aspect of the invention, the strip element is integrated with the plate member and extends across the cam groove.

According to the fourth aspect of the invention, the slide cam member has an increased rigidity allowing for a secured longer service.

Further, to achieve the object, a fifth aspect of the invention provides a sliding insert type connector in which female and male connector housings have at a side of one connector housing thereof a slide member slidable thereon for an advancing travel thereof and for a retreating travel thereof and formed with an oblique cam element and at a side of the other connector housing thereof a cam follower engageable with the oblique cam element so that the slide member drives in the advancing travel thereof the other connector housing to be attracted for insertion to the one connector housing to couple the female and male connector housings with each other and in the retreating travel thereof the female and male connector housings to be de-coupled from each other, wherein a sliding surface of the slide member with respect to the one connector housing has a raised part formed thereon, in a longitudinal direction thereof, to be brought into a line contact with the one connector housing in the advancing travel of the slide member and in the retreating travel thereof.

According to the fifth aspect of the invention, when a slide member advances or retreats, a raised part thereon is brought into a line contact with a wall of a male or female connector housing, with a reduced frictional force acting therebetween, allowing for a facilitated smooth operation to the slide member with a relatively small operation force.

According to a sixth aspect of the invention, the slide member is configured in a C form with an operation portion and a pair of actuation portions, the one connector housing has at upper and lower parts of each side wall thereof a pair of insertion holes formed therethrough for insertion of respective fret ends of the pair of actuation portions, and the pair of actuation portions each have on each of upside and downside thereof the raised part integrally formed thereon for the line contact with a corresponding one of the pair of insertion holes.

According to the sixth aspect of the invention, when the slide member advances or retreats, the respective raised parts on upside and downside of a respective one of its actuation portions are each brought into the line contact with an edge of a corresponding one of insertion holes formed at upper and lower parts of both side walls of the female or male connector housing, with a possibly reduced frictional force acting therebetween, permitting a facilitated smooth sliding of the slide member with a small operation force.

According to a seventh aspect of the invention, the pair of actuation portions are each formed with a angled guide groove as the oblique cam element, the raised part on the upside of an upper actuation portion of the pair of actuation portions is straight-linearly continuously formed thereon, bridging over the angled guide groove of the upper actuation portion, and the raised part on the downside of a lower actuation portion of the pair of actuation portions is straight-linearly continuously formed thereon, bridging over the angled guide groove of the lower actuation portion.

According to the seventh aspect of the invention, a guide groove of the slide member is kept from getting deformed wider with the respective edges of the corresponding insertion hole in contact with the raised parts on the upside and downside of the respective actuation portion of the slide member, permitting both advancement and retreat of the slide member to be made smooth, allowing for a facilitated coupling of the female and male connector housings, as well as a facilitated de-coupling thereof, in addition to an increased rigidity of the respective actuation portion.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1:
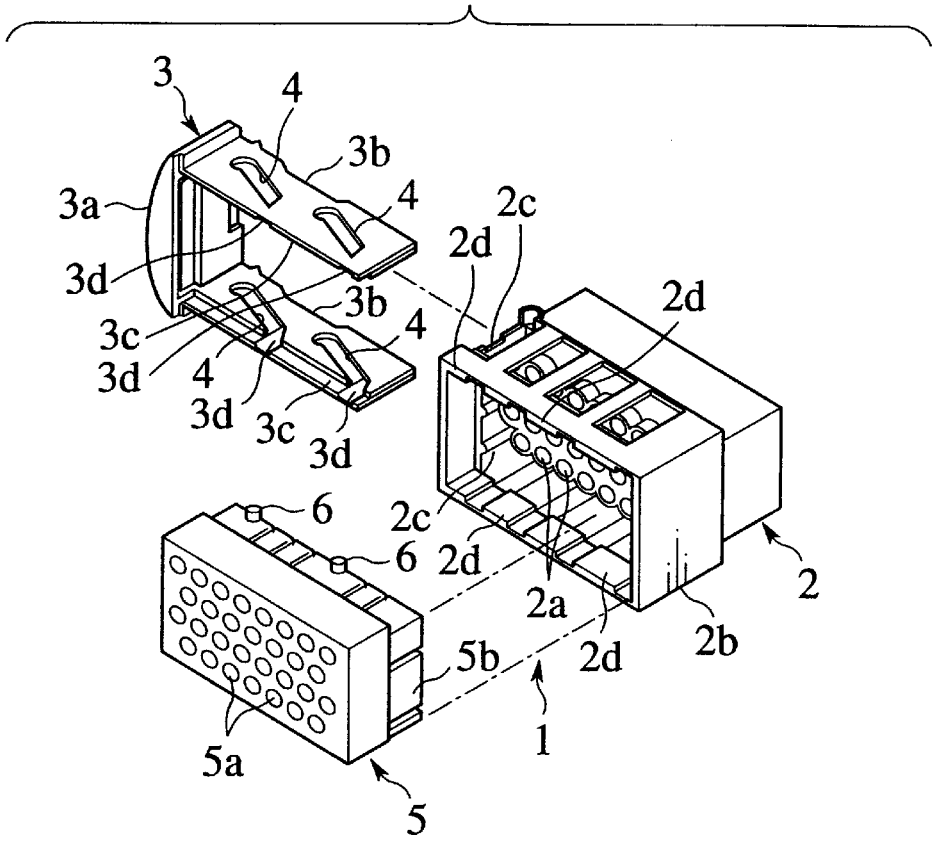
FIG.1 PRIOR ART
FIG. 1 is an exploded view of a conventional sliding insert type connector.
Figure 2:
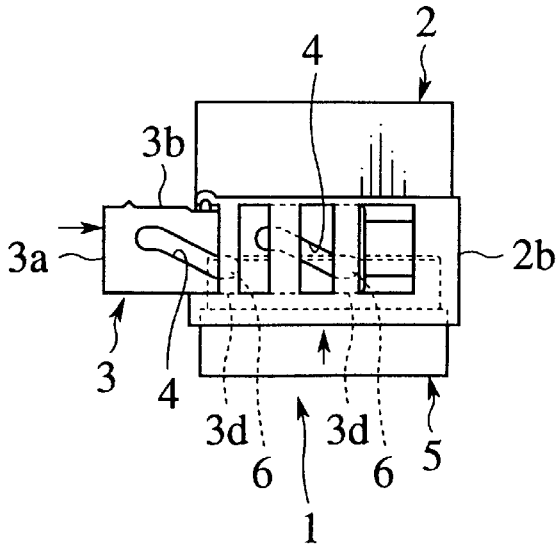
FIG.2 PRIOR ART
FIG. 2 is a plan of the conventional connector of FIG. 1 on the way of a sliding insertion thereof.

There will be detailed below the preferred embodiments of the present invention with reference to the accompanying drawings. Like members are designated by like reference characters.

Figure 3:
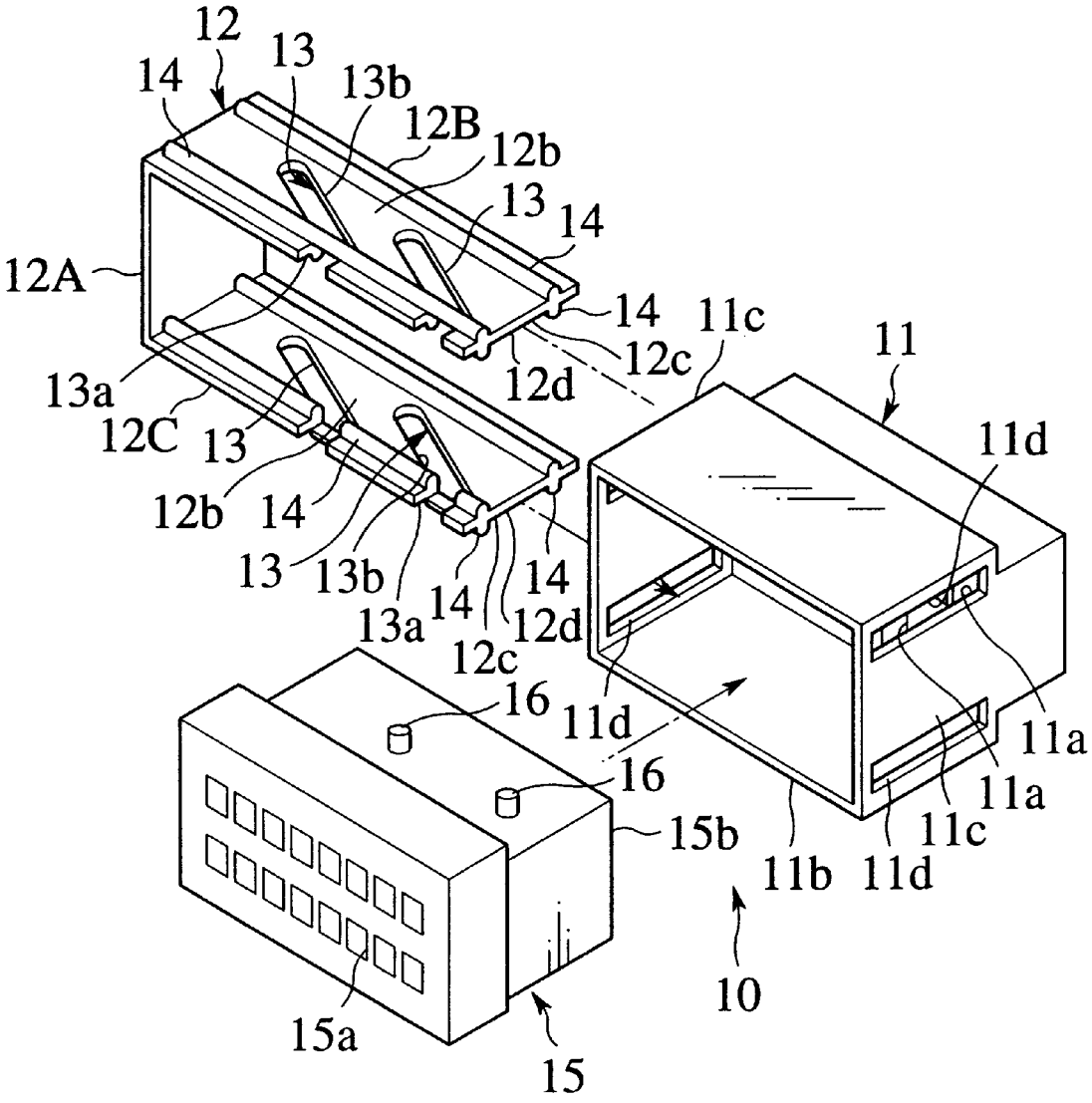
FIG. 3 is an exploded view of a sliding insert type connector according to an embodiment of the invention.
Figure 4:
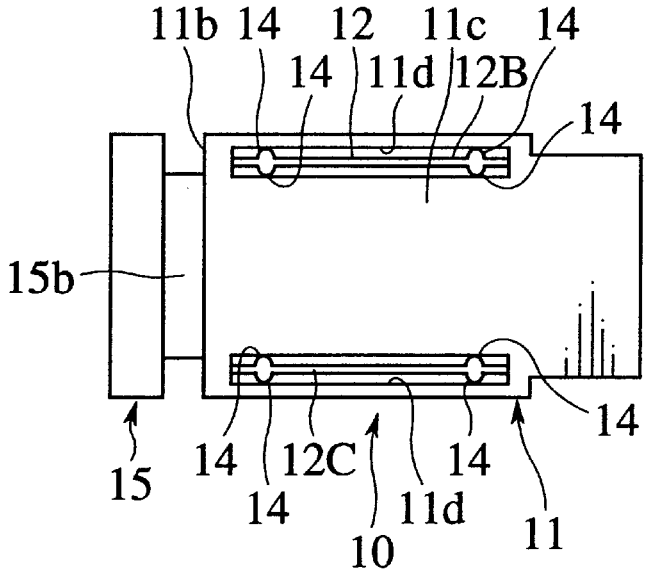
FIG. 4 is a side view of the sliding insert type connector of FIG. 3.
Figure 6:
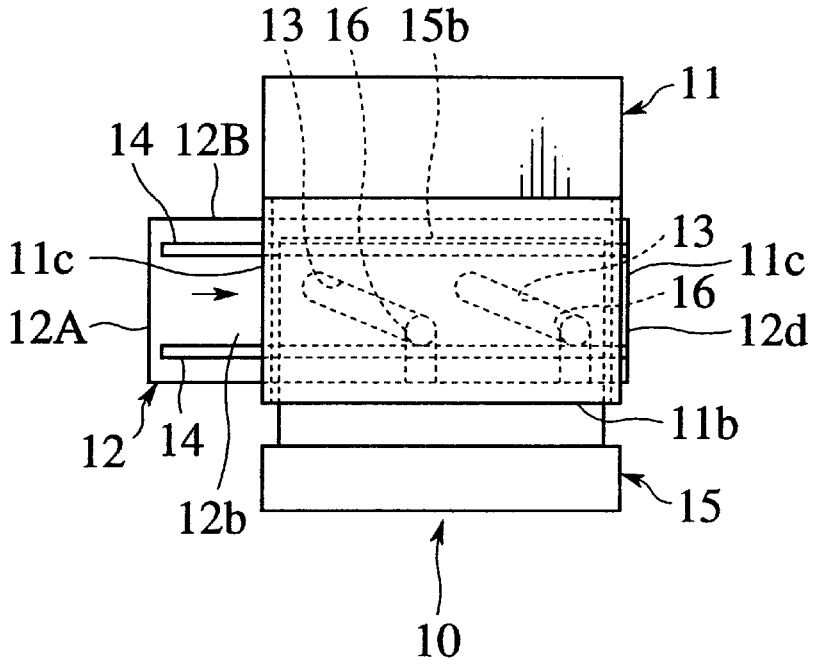
FIG. 6 is a plan view illustrating a state of the sliding insert type connector of FIG. 3, as the slide member is on the way of an advancing travel.
Figure 7:
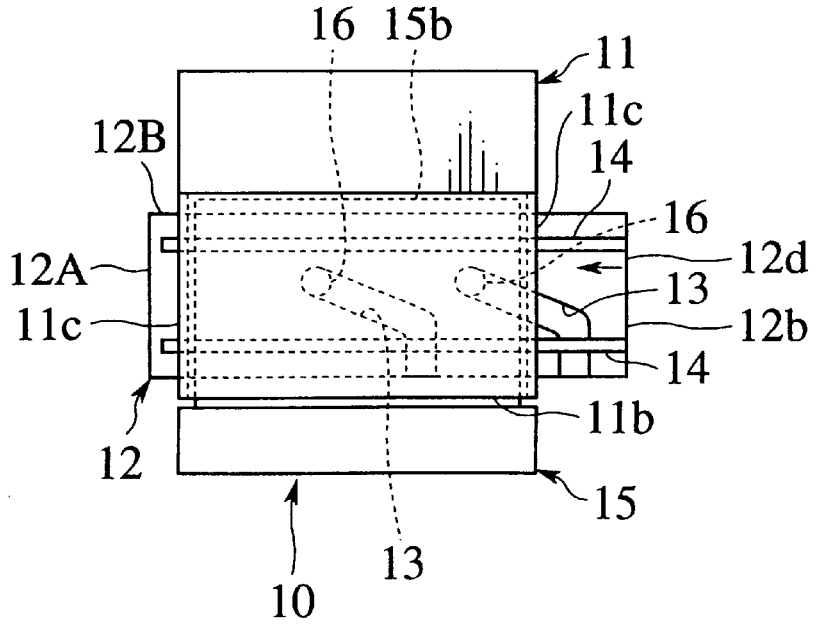
FIG. 7 is a plan view illustrating a state of the sliding insert type connector of FIG. 3, as the slide member has come to an end of the advancing travel.

FIG. 3 shows an exploded view of a sliding insert type connector 10 according to an embodiment of the invention, FIG. 4, a side view of the connector 10, and FIGS. 6 and 7, plan views of the same.

The sliding insert type connector 10 includes a substantially parallelepiped female connector housing 11, a substantially parallelepiped male connector housing 15, and a sliding cam member 12 (hereafter simply "slider"). The connector housings 11, 15 as well as the slider 12 are made of an insulating synthetic resin.

The female connector housing 11 has a vertically stepped rear portion formed with a plurality of terminal accommodation chambers 11*a* for accommodating a plurality of rear contacts such as connector pins, and a front portion configured in a rectangular tubular form to constitute a hood portion 11*b* as a receptacle.

The slider 12 has a pair of upper and lower horizontal actuation portions 12B, 12C reciprocally slidably fitted between upper and lower walls of the hood portion 11*b* of the female connector housing 11. The upper and lower actuation portions 12B, 12C are each formed with a pair of central and right guide grooves 13 as parallel cam elements each extending in a leftwardy inclined oblique direction relative to a slider insertion direction in which the slider 12 is fitted into the hood portion 11*b*. Each guide groove 13 is angled, i.e., it has an opened right end groove as a cam follower introducing part 13*a* thereof interrupting a front edge of the upper or lower actuation portion 12B/12C and directed, at right angles thereto, a substantially straight groove as an oblique part 13*b* thereof communicating with the right end groove and extending in the oblique direction, and a left end closing the straight groove. The slider 12 is configured in a C or channel form with the upper and lower horizontal actuation portions 12B, 12C and a vertical operation portion 12A interconnecting respective left ends of the actuation portions 12B, 12C with each other.

The male connector housing 15 has a front portion formed with a plurality of terminal accommodation chambers 15*a* for accommodating a plurality of front contacts such as mating connector pins, and a vertically stepped rear portion configured in a rectangular tubular form to constitute an insert portion 15*b* as a plug to be inserted into the hood portion 11*b*. The insert portion 15*b* is comprised of a wall defining therein an electrical connection region for connection between the front and rear contacts, and has integrally formed on the wall an upper pair of central and right pillar-shaped projections 16 as upper cam followers engageable with the central and right guide grooves 13 of the upper actuation portion 12B of the slider 12, respectively, and a lower pair of central and right pillar-shaped projections 16 as lower cam followers engageable with the central and right guide grooves 13 of the lower actuation portion 12C of the slider 12, respectively.

The hood portion 11*b* of the female connector housing 11 has a pair of left and right side walls 11*c* each formed, along upper and lower edges thereof, with a pair of upper and lower rectangular slots 11*d* for insertion of respective leading free right ends 12*d* of the upper and lower actuation portions 12B, 12C of the slider 12. As shown in FIG. 3 by an arrow, upon assemblage, the right end 12*d* of each actuation portion 12B/12C of the slider 12 is first inserted through a corresponding one of the upper and lower slots 11*d* of the left side wall 11*c* of the hood portion 11*b*. The upper and lower projections 16 on the insert portion 15*b* of the male connector housing 15 are each introduced through the cam follower introducing part 13*a* of a corresponding one of the guide grooves 13 of the slider 12, into the straight part 13*b* of the corresponding groove 13, cf. FIG. 6. Then, as shown in FIG. 7, the inserted right end 12*d* of actuation portion 12B/12C is further pushed forward, passing through a corresponding one of the upper and lower slots 11*d* of the right side wall of the hood portion 11*b*, thus projecting outside of this wall, until it has a predetermined projection length.

Figure 5A:
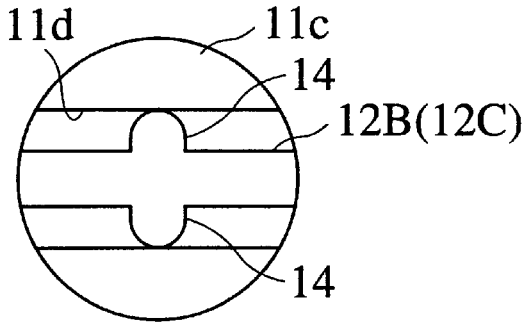
FIG. 5A is a side view of a pair of raised parts on a slider of the sliding insert type connector of FIG. 3.

The upper and lower actuation portions 12B, 12C of the slider 12 each have a couple of longitudinally extending front and rear parallel pairs of upper and lower ribs 14 integrally formed on upper and lower surfaces 12*b*, 12*c* thereof, respectively. As shown in FIGS. 4 and 5A, when the upper and lower actuation portions 12B, 12C of the slider 12 are inserted into the hood portion 11*b* of the female connector housing 11, the ribs 14 are each brought into a line-contact at a round top thereof with an upper or lower side of a corresponding one of the upper and lower rectangular slots 11*d*. The respective ribs 14 may preferably have their right ends tapered or rounded for smooth application to the slots 11*d*. Left ends of the ribs 14 may also be tapered or rounded for a smooth starting of a retreat. The left end of at least one of the ribs 14 may however be left upright or adequately deformed for a locking engagement with an edge of at least one slot 11*d*.

On each actuation portion 12B, 12C, the rear pair of ribs 14 are continuously formed along length of the actuation portion 12B, 12C. Likewise, an upper or outer rib 14 of the front pair of ribs on the upper actuation portion 12B and a lower or outer rib 14 of the front pair of ribs on the lower actuation portion 12C are each continuously formed, bridging over the respective cam follower introducing parts 13*a* of corresponding two of the four guide grooves 13.

However, a lower or inner rib 14 of the front pair of ribs on the upper actuation portion 12B and an upper or inner rib 14 of the front pair of ribs on the lower actuation portion 12C are each cut off over widths of the cam follower introducing parts 13*a* of the corresponding guide grooves 13, so that the introducing part 13*a* of each guide groove 13 is opened in a vertically inward direction as well as in a laterally frontward direction, permitting a corresponding one of the four projections 16 to be introduced therethrough into the straight groove part 13*b* in a facilitated manner. Respective ends of cut segments of the front inner ribs 14 may preferably be tapered or rounded to prevent their binding with sides of the slots 11*d*.

For a coupling, the three components 11, 12, 15 of the sliding insert type connector 10 are handled as follows.

As shown by the arrow of FIG. 3, the right ends 12*d* of the upper and lower actuation parts 12B, 12C of the slider 12 are applied to the upper and lower slots 11*d* of the left side wall 11*c* of the hood portion 11*b* of the female connector housing 11, and as shown by an arrow of FIG. 6, the slider 12 is pushed forth at the operation portion 11A till it has a matching position to the female connector housing 11, when the right ends 12*d* are checked to have exceeded a right outside of the hood portion 11*b* by a sensible length.

Then, the insert portion 15*b* of the male connector housing 15 is applied into a front opening of the hood portion 11*b* so that the upper and lower projections 16 on the insert portion 15*b* are engaged with the cam follower introducing parts 13*a* of the guide grooves 13 of the upper and lower actuation portions 12B, 12C and thereby introduced to right ends of the oblique straight parts 13*b* of the guide grooves 13, which can be sensed by a hitting or click.

Then, the slider 12 is pushed to advance to an end position shown in FIG. 7, forcing the oblique parts 13*b* of the guide grooves 13 to rearwardly attract the projections 16, whereby the insert portion 15*b* is drawn to be wholly fitted inside the hood portion 11*b*, when the projections 16 are each located at the closed left end of a corresponding one of the guide grooves 13.

In a complete coupling state of the female and male connector housings 11, 15, the right ends 12*d* of the upper and lower actuation parts 12B, 12C of the slider 12 extrude outside the right side wall 11*c* of the hood portion 11*b* by a predetermined length, and an inside of the operation portion 12A rests on an outside of the left wide wall 11*c* of the hood portion 11*b*.

For a de-coupling of the connector housings 11, 15, the slider 12 is to be pushed leftwardly as shown by an arrow in FIG. 7.

All the way of advance or retreat of the slider 12, the inner and outer ribs 14 are each brought into a longitudinal line contact (cf. FIG. 5A) at the round top with the upper or lower side of slot 14. As the line contact has a very narrow contact area, associated frictional forces are small, too. As the frictional forces acting between the female connector housing 11 and the slider 12 are small, the slider 12 is operative with a reduced operational force allowing for a facilitated smooth travel.

Further, the front outer ribs 14 of the actuation portions 12B, 12C are continuously formed to integrally connect both sides of the cam follower introducing part 13*a* of each guide groove 13 in a bridging manner, whereby the introducing part 13*a* is kept from expanding in the slider insertion direction with concentrated stresses, thus permitting a smooth advance or retreat of the slider 12 irrespective of the guide grooves 13 that extend in a crossing direction to the slider insertion direction. The male and female connector housings 11, 15 can thus be coupled with each other or de-coupled from each other in a facilitated manner without errors. Moreover, the actuation portions, 12B, 12C of the slider 12 have their rigidity increased with the ribs 14.

Figure 5B:
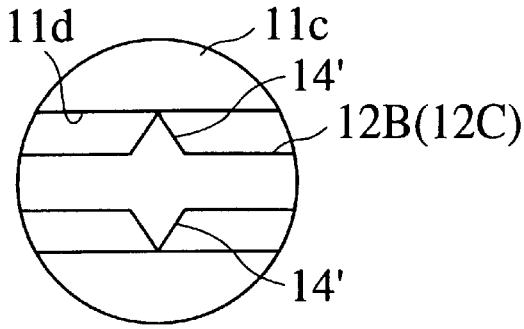
FIG. 5B is a side view of a pair of raised parts according to a partial modification of the embodiment of FIG. 3.

FIG. 5B shows a pair of upper and lower modified ribs 14'.

Each modified rib 14' is integrally formed on either of an upside and a downside of either of a pair of upper and lower actuation portions 12B, 12C of a slider and shaped in a triangular form in section, and bas a sharp angled vertex for a smoother line contact with either of upper and lower sides of a corresponding insertion slot 11*d*.

The round and triangular ribs 14, 14' may be cut in short lengths. In particular, the round rib 14 may be cut in very short lengths to constitute a series, array or matrix of pseudo-pointed contacting parts.

While preferred embodiments of the present invention have been described using specific terms, such description is for illustrative purposes, and it is to be understood that changes and variations may be made without departing from the spirit or scope of the following claims.

What is claimed is:

1. A connector comprising:

a first and a second set of contacts;

a first and a second housing for holding the first and the second set of contacts, respectively, the first housing being formed with a plug portion having a first wall defining therein a first region for electrical connection between the first and the second set of contacts, the second housing being formed with a receptacle portion having a second wall defining therein a second region for reception of the plug portion of the first housing;

a slide cam member frictionally slidable between the first and second walls for actuating the plug portion of the first housing to be slid into the second region; and pointed means for causing the slide cam member to keep line contact with one of the first and second walls when the slide cam member frictionally slides between the first and second walls, the pointed means having a cross section which has one or more points of contact with at least one of the first and second walls.

2. The connector as claimed in claim 1, wherein the slide cam member is frictionally slidable between the first and second walls for actuating the plug portion of the first housing to be slid out of the second region.

3. The connector as claimed in claim 1 or 2, wherein:

the first wall has a cam follower integrated therewith;

the slide cam member comprises a plate member formed with a cam groove engageable with the cam follower; and the pointed means comprises a strip element on the plate member.

4. The connector as claimed in claim 3, wherein the strip element is integrated with the plate member and extends across the cam groove.

5. The connector as claimed in claim 3, wherein said pointed means has a plurality of protrusions at both inner and outer slide surfaces of the slide cam member, each of said protrusions being in line contact with either one of the first and second walls;

wherein said protrusions on the inner slide surface are discontinuous at said cam grooves.

6. The connector as claimed in claim 1, wherein said pointed means has a plurality of protrusions at a slide surface of the slide cam member, each of said protrusions being in line contact with either one of the first and second walls.

7. The connector as claimed in claim 6, wherein each of said protrusions has a cross section in the shape of a semicircle.

8. The connector as claimed in claim 6, wherein said each protrusion has a cross section in the shape of a triangle.

9. The connector as claimed in claim 1, wherein said pointed means has a plurality of protrusions at both inner and outer slide surfaces of the slide cam member, each of said protrusions being in line contact with either one of the first and second walls.

10. The connector as claimed in claim 1, wherein said protrusions on the outer slide surface are continuous.

11. A sliding insert type connector comprising: female and male connector housings having at a side of one of said connector housings a slide member slidable thereon for advancing travel and for retreating travel; said one connector housing being formed with an oblique cam element; and formed at a side of the other of said connector housing, a cam follower engageable with the oblique cam element so that the slide member engages during advancing travel the other connector housing to couple the female and male connector housings with each other and during retreating travel the female and male connector housings are de-coupled from each other;

a sliding surface of the slide member having a raised part formed thereon, in a longitudinal direction, said raised part having a cross section which has one or more points of contact with at least one of said one connector housing, said raised part being brought into a line contact with the one connector housing during the advancing travel and in the retreating travel of the slide member.

12. The sliding insert type connector as claimed in claim 11, wherein:

the slide member is configured in a C form with an operation portion and a pair of actuation portions;

the one connector housing has at upper and lower parts of each side wall thereof a pair of insertion hole formed therethrough for insertion of respective free ends of the pair of actuation portions; and the pair of actuation portions each have on each of upside and downside thereof the raised part integrally formed thereon for the line contact with a corresponding one of the pair of insertion holes.

13. The sliding insert type connector as claimed in claim 12, wherein:

the pair of actuation portions are each formed with a angled guide groove as the oblique cam element;

the raised part on the upside of an upper actuation portion of the pair of actuation portions is straight-linearly continuously formed thereon, bridging over the angled guide groove of the upper actuation portion; and the raised part on the downside of a lower actuation portion of the pair of actuation portions is straight-linearly continuously formed thereon, bridging over the angled guide groove of the lower actuation portion.

14. A connector comprising:

a first and a second set of contacts;

a first and a second housing for holding the first and the second set of contacts, respectively, the first housing being formed with a plug portion having a first wall defining therein a first region for electrical connection between the first and the second set of contacts, said first wall having a cam follower integrated therewith, the second housing being formed with a receptacle portion having a second wall defining therein a second region for reception of the plug portion of the first housing;

a slide cam member frictionally slidable between the first and second walls for actuating the plug portion of the first housing to be slid into the second region, said slide cam member comprising a plate member formed with a cam groove engageable with the cam follower; and line contact means for bringing the slide cam member in line contact with one of the first and second walls, said line contact means comprising a strip element on the plate member, wherein the strip element is integrated with the plate member and extends across the cam groove.

15. The connector as claimed in claim 14, wherein the slide cam member is frictionally slidable between the first and second walls for actuating the plug portion of the first housing to be slid out of the second region.

* * * * *

UNITED STATES PATENT AND TRADEMARK OFFICE

CERTIFICATE OF CORRECTION

PATENT NO. : 6,045,375
DATED : April 4, 2000
INVENTOR(S) : Aoki et al.

It is certified that error appears in the above-identified patent and that said Letters Patent is hereby corrected as shown below:

Column 8,
Claim 8,
Line 20, "said each" should read -- each of said --.

Claim 10,
Line 28, "protrusions" should read -- pointed means --.

Claim 11,
Line 32, after "retreating travel", insert -- within the female housing --.
Line 36, after "travel", insert -- of --.

Claim 12,
Line 54, "hole" should read -- holes --.
Line 57, "each have" should read -- each having --.

Claim 13,
Lines 64-65, "a angled" should read -- an angled --.

Signed and Sealed this

Eleventh Day of September, 2001

*Attest:*

Nicholas P. Godici

NICHOLAS P. GODICI
*Acting Director of the United States Patent and Trademark Office*

*Attesting Officer*